US007000884B2

(12) United States Patent
Bucknell

(10) Patent No.: US 7,000,884 B2
(45) Date of Patent: Feb. 21, 2006

(54) PAVING SYSTEM

(76) Inventor: Martin Bucknell, 39 Waveney, Grove Hill, Hemel Hempstead, Herts HP2 6DQ (GB)

( * ) Notice: Subject to any disclaimer, the term of this patent is extended or adjusted under 35 U.S.C. 154(b) by 0 days.

(21) Appl. No.: 10/617,499

(22) Filed: Jul. 11, 2003

(65) Prior Publication Data

US 2005/0098704 A1 May 12, 2005

(30) Foreign Application Priority Data

Jul. 12, 2002 (GB) ..... 0216198

(51) Int. Cl.
*E01C 5/22* (2006.01)
*E04F 15/14* (2006.01)

(52) U.S. Cl. ..... 249/2; 52/318; 52/389; 404/18

(58) Field of Classification Search ..... 404/17, 404/18, 28, 37; 52/318, 384, 389; 249/2
See application file for complete search history.

(56) References Cited

U.S. PATENT DOCUMENTS

| | | | | | |
|---|---|---|---|---|---|
| 184,817 | A * | 11/1876 | Anderson | 404/18 |
| 368,398 | A * | 8/1887 | Hoyt | 404/17 |
| 1,640,796 | A * | 8/1927 | Miller , Jr. | 404/17 |
| 1,936,536 | A * | 11/1933 | Bates | 52/318 |
| 2,049,428 | A * | 8/1936 | Denk | 52/384 |
| 3,025,772 | A * | 3/1962 | Benno | 404/18 |
| 3,238,682 | A * | 3/1966 | Tracey et al. | 404/18 |
| 3,444,660 | A * | 5/1969 | Feichter et al. | 52/384 |
| 3,855,747 | A * | 12/1974 | Langan | 404/18 |
| 4,351,694 | A * | 9/1982 | Mathis | 156/574 |
| 4,932,182 | A * | 6/1990 | Thomasson | 52/318 |
| 5,406,763 | A | 4/1995 | Al-Saleh | |
| 5,418,036 | A * | 5/1995 | Tokikawa et al. | 52/384 |
| 5,937,602 | A | 8/1999 | Jalbert | |
| 6,625,951 | B1 * | 9/2003 | McCarthy | 52/747.1 |
| 6,862,855 | B1 * | 3/2005 | Milum et al. | 52/384 |

FOREIGN PATENT DOCUMENTS

| | | |
|---|---|---|
| DE | 2438822 A | 2/1976 |
| FR | 2688240 A | 9/1993 |
| GB | 806982 | 1/1959 |
| GB | 2129468 A | 5/1984 |
| GB | 2191411 A | 12/1987 |

* cited by examiner

*Primary Examiner*—Michael Safavi
(74) *Attorney, Agent, or Firm*—Bradley N. Ruben

(57) ABSTRACT

In one aspect the present invention provides an apparatus for forming paving from a settable material and which comprises: a base frame having a plurality of upstanding walls which, alone or together with an adjacent positioned said base frame, defines a plurality of compartments within which the settable material may be placed to be moulded by the compartments of the base frame(s) into a plurality of blocks, the base frame being adapted to be left in situ; and a grout frame which is of a substantially corresponding shape in plan to the base frame and which is positioned atop the walls of the base frame in use, extending the walls upwardly. Amongst further aspects are: provision for modular interlinking of matrix type base frames to facilitate paving substantial areas in a cohesive manner; ease of storage and distribution through use of a flat pack construction; yet further improved ease of use in areas of high rainfall by providing a hybrid tiling system; and improved integrity through use of an apertured floor.

15 Claims, 5 Drawing Sheets

PAVING SYSTEM

FIELD OF THE INVENTION

The present invention concerns improvements in and relating to paving and particularly to a method and apparatus for applying a settable material such as, for example, cement or concrete to a surface to form paving.

BACKGROUND TO THE INVENTION

There have, in recent years, been a number of important developments in the field of paving extending the range of options available for materials and finishes and the way in which the paving is laid. One of the most important developments was the introduction of pattern-imprinted concrete to enable an area of paving to be given the appearance of block paving when, in fact, it is formed in situ as a layer of concrete is subsequently coloured and imprinted using a set of moulds for the pattern design, pressed down from above. An example of this system is described in GB 2,193,989A. Among benefits that can be obtained from this process is the ability to obtain a block paved appearance with a substantially monolithic formation that stops through-growth of weeds. Furthermore, the paving can be laid comparatively rapidly and less labour intensively than conventional block paving. However, the level of skill required to lay the pattern imprinted concrete paving is substantially higher than for block paving and there are tight constraints in when and how the pattern-imprinted concrete can be laid.

Laying pattern-imprinted concrete during hot periods should be avoided to prevent accelerated concrete curing which can lead to crack formation. The quality of the installation during hot spells can also be undermined as the installers are under greater pressure to rush the process before the concrete is too hard to work with, i.e. loss of pattern definition.

Given constraints such as the finite curing time window, the need to pattern imprint substantially the full area to be paved in one session in order to avoid unsightly discontinuities in the pattern, to ensure the colour is consistant throughout and the difficulty in rectifying any errors once the pattern has been applied, speed, care and skill are all needed. Luck with the weather also helps. As with any process based on curing of cement/concrete, and especially with coloured pattern-imprinted concrete, if not sheltered a sudden downpour could be disastrous, affecting the colour and imprint if the concrete had not hardened sufficiently or the job was still in progress at any stage.

Therefore climatic conditions have a great bearing on the outcome of pattern imprinted concrete quality, which deters many block paving and paving companies from getting involved as this could lead to jobs being excavated and relaid.

Furthermore, although the monolithic construction gives one of the key benefits of pattern-imprinted concrete, some provision still has to be made for concrete expansion and contraction during varying weather conditions and possible slight ground movement, by including expansion and contraction joints or crack control joints (gap) in the formation. These are generally placed at certain intervals at the discretion of the installer and can in some patterns appear unsightly. Placing of these joints is no guarantee that cracks are prevented, as has happened on many occasions.

It is a general objective of the present invention to provide an improved paving system which exploits benefits of the existing pattern-imprinted concrete systems, while increasing the ease with which they can be laid, reducing the skill levels necessary.

It is an objective to mitigate against the need for visible expansion lines and enable the paving to be built up in manageable modular regions without undermining the integrity or the appearance of the paving. It is a further objective to enable good access to be had to remote areas of the paving being laid before the concrete has cured.

It is a further general object to make the system economical to implement, and in combination with the reduction in skill required, to enable a pattern-imprinted concrete type of approach to be used far more widely as an alternative to the conventional cobble-laying, block paving, slabs or tarmacing of driveways, patios and other paved areas in domestic and commercial premises.

It is an objective to be able to lay paving imitating the look of pattern imprinted concrete in hot or inclement weather conditions reducing downtime, whilst maintaining quality.

It is an objective to prevent cracking throughout the installation by providing a system that facilitates movement, expansion and contraction.

It is an objective to facilitate better access to the client into their home by boards placed over the area being paved, a difficulty with normal pattern imprinted concrete paving during the setting period.

SUMMARY OF THE INVENTION

According to a first aspect of the present invention there is provided an apparatus for forming paving from a settable material and which comprises a base frame which, alone or together with an adjacent positioned said base frame, defines a plurality of compartments within which the settable material may be placed to be moulded by the compartments of the base frame(s) into a plurality of blocks, wherein the base frame is adapted to be left in situ.

The base frame is particularly preferably a matrix frame defining several compartments and adapted to be used with other such base frames and provided with one or more apertures in a perimeter wall of the base frame whereby settable material may flow from a first base frame to an adjacent base frame so that an expansive area to be paved may be covered by multiple matrix frames and each matrix frame interlinked by the settable material. A particular benefit of this is that expansive areas may be covered rapidly and efficiently using the matrix frames as modules and with the resulting whole expanse of paving being cohesive. The cohesive interlinked expanse allows for expansion of the concrete by shear of the interlinking concrete and even where shear of the interlinking concrete occurs the sheared interlinking concrete stubs will persist in maintaining the spacing apart of the matrix frames.

During hot spells the compartment structure will allow shrinkage due to accelerated curing, without cracking, with improved control as installers can lay at will without rushing the process. During wet weather the concrete can be covered in plastic sheeting at any stage so that the paving can be formed and covered in sections without loss of colour and pattern. The walls of the base frame(s) between adjacent compartments preferably have one or more apertures therethrough to enable a settable material to flow from one compartment to the next to interlink the paving blocks formed as the settable material sets. The base frame is preferably of matrix form defining said plurality of compartments within which the settable material may be placed. Suitably there are a plurality of the apertures and these are formed as crenellation recesses in the upper, in use, edges of the walls between the compartments of the base frame(s).

Preferably further apertures are formed in the walls between compartments lower down the walls than the crenellation recesses.

Suitably the crenellation recesses in the walls between compartments are at least partly staggered as they run through the walls, and if fully staggered and thereby occluded are provided only in combination with said further apertures. One or more recesses may be formed in the walls between compartments lower down the walls than the upper edges of the walls.

In accordance with a major aspect of the present invention the apparatus suitably further has a grout frame which is of a substantially corresponding shape in plan to the base frame in order to be positioned atop the walls of the base frame in use extending the walls upwardly. The grout frame is preferably a pre-assembled frame but could be assembled on site by the paving contractor of a set of individual elongate frame members. Thus the grout frame is a frame that is either wholely preformed as an assembled frame or is at least formed of elongate pre-formed frame members that are assembled together relative to each other on site. This contrasts to the prior art where any grouting is not formed as a frame/of frame members but instead always applied as a fluid paste/putty or mortar that is inserted between blocks of solid paving.

The grout frame preferably is an assembly comprising a grout carrier/cover component carrying on its face that is to be placed atop the base frame a component to serve as the grouting, which latter is releasably held to the grout carrier/cover component so that it may be left in place between the paving blocks when the grout carrier/cover component is removed. It is to be understood that the expression "to serve as the grouting" is intended to mean that the item in question need not be a conventional grouting mortar, putty or paste composition but rather is serving as grouting by fitting in the interstitial space where grouting paste is normally applied, simulating the appearance of grouted interstices between the blocks. Indeed, in the preferred embodiment the grouting component of the grout frame is not a soft putty or paste but a frame-shaped moulding of plastics or other suitable material.

Alternatively the frame that mounts atop the base frame is a grout channel-forming frame and the frame is formed of grouting material or at least serves in use as the grouting. In this or the preceding aspect/embodiment the part that serves as the grouting being pre-configured to a frame shape in plan greatly facilitates the grouting stage of the paving process. Furthermore, the use of a grouting part that is embedded in the setting concrete of the blocks as a "pre-grout" and therefore firmly held in place overcomes/mitigates against the problem of grout dislodgement that occurs with the conventional application of grouting mortar, putty or paste after setting of the concrete. Such dislodgement of conventional grout occurs frequently when high pressure jet washes are used on conventional block paving.

The grouting component suitably extends beyond the top edge of the grout carrier cover component into the compartments to be embedded in the settable material.

In any of the embodiments the base frame is particularly preferably of cardboard or other degradable material that will degrade in situ over time and preferably is a flat pack frame formed of one or more sheets that are assembled/folded to form the frame. Suitably the base frame has one or more transverse walls bridging between a plane parallel opposed pair of walls, the or each of which transverse walls is configured with a tab at each end defining a slit to be slotted in place down onto a corresponding one of the opposing walls to lock the walls relative to each other. Each tab with slit may be further used to hold one base frame to an adjacent positioned base frame.

Preferably the base frame is provided with a floor and particularly preferably the floor is apertured so that the settable material is substantially held within the compartments but nevertheless in contact with the underlying ground. A particularly preferred arrangement is the provision of a large central aperture through the floor of each compartment.

According to a further aspect of the present invention there is provided a method of forming a paving from a settable material and which comprises the steps of providing an apparatus as defined in one of the above statements, laying it on the surface to be paved, positioning the settable material into the compartments of the apparatus and allowing the settable material to set, embedding the base frame(s) of the apparatus in situ in the paving. This particularly suitably further comprises, prior to or after placing the settable material into the compartments, placing a said grout frame atop the base frame.

In an adaptation of the method and apparatus of the invention for use in a 'hybrid' manner, the apparatus suitably further comprises a set of paving tiles, one to cap each block and which are each configured to sit atop the walls of a respective compartment and be held in place by the setting of the settable material. This is particularly useful in areas of unpredictable/high rainfall where use of preformed capping further simplifies laying of the paving while ensuring a quality finish.

BRIEF DESCRIPTION OF THE DRAWINGS

Preferred embodiments of the present invention will now be more particularly described, by way of example, with reference to the accompanying drawings, wherein.

DESCRIPTION OF THE PREFERRED EMBODIMENTS

Figure 1:
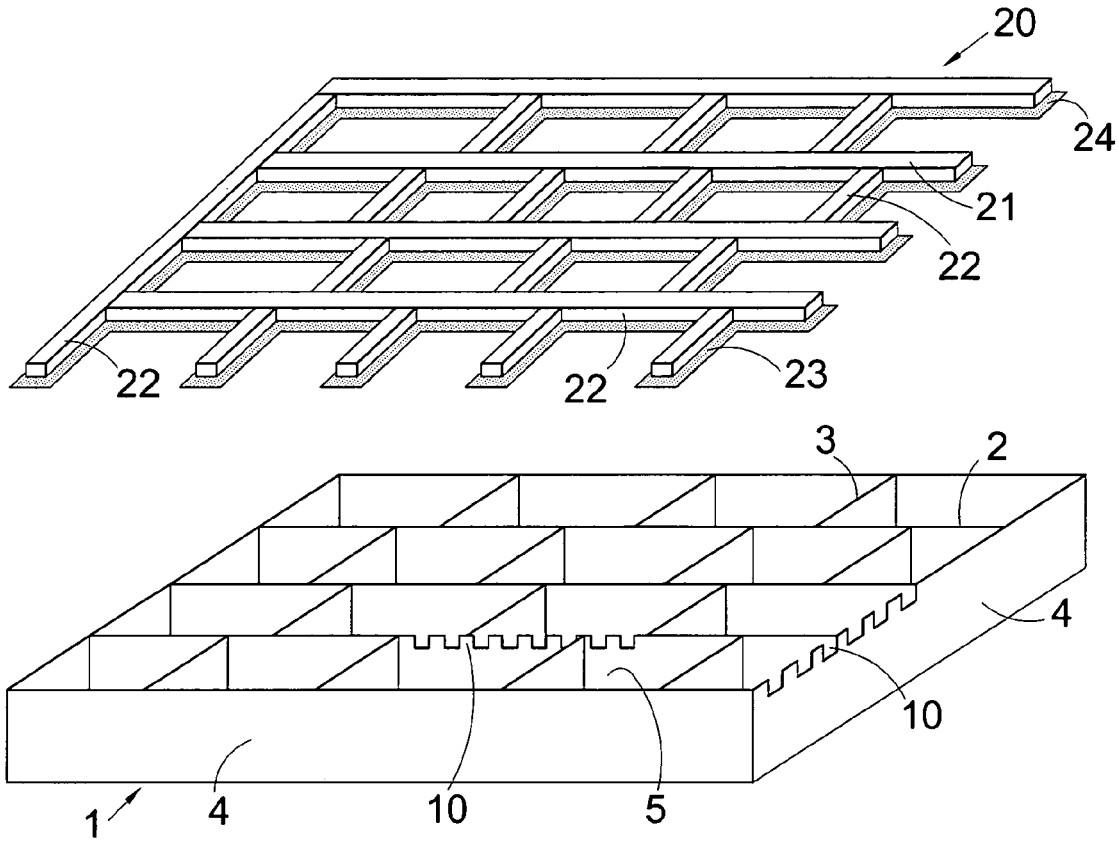
FIG. 1 is a schematic perspective view from above of a base matrix frame and a grout-holding/channel-forming frame that, in use, is superimposed on the base matrix frame.

Referring firstly to FIG. 1, the primary component of the new paving system is a base matrix frame 1 that is partitioned into a series of compartments by dividing walls 2,3 extending longitudinally and transversely of the frame 1. This base matrix frame 1 is effectively a mould into which fresh concrete is poured with the individual compartments 5 defining the individual blocks/cobbles of the paving.

As can be seen, the partitioning walls 2,3 are of substantially the same height as the outer boundary walls 4 of the matrix frame 1. In a preferred construction the base matrix frame 1 is pre-formed from card or compressed paper that is sealed in a wax or PVA coating for added strength and water resistance. Indeed, the use of card or compressed paper or similar environmentally degradable or biodegradable material serves two roles. Not only does it keep the costs of the system very low, but importantly it also serves a technical function in that when the card or paper begins to degrade over time the degradation of the walls 2,3 and 4 of the base matrix frame 1 gives rise to voids that serve as expansion zones or shear lines.

Whereas the partition walls 2,3 divide the concrete that is poured into the matrix base frame 1 into discrete blocks, the whole will have a monolithic nature, each block being linked to neighbouring blocks, since apertures 10 are provided through the partition walls 2,3 and also through the outer walls 4 that abut, in use, adjacent base matrix frames. As illustrated, these apertures 10 are in the form of a series of recesses spaced at regular intervals along the upper, in use, edge of each partition wall 2,3 or boundary wall 4 of the base matrix frame 1, giving the walls 2,3,4 a crenellated appearance, with a raised portion 11 between each crenel recess/aperture 10.

Figure 3:
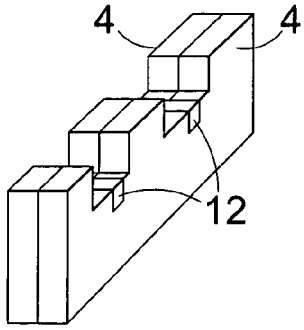
FIG. 3 is a close-up perspective view of abutting walls of adjacent base matrix frames clipped one to another.
Figure 2:
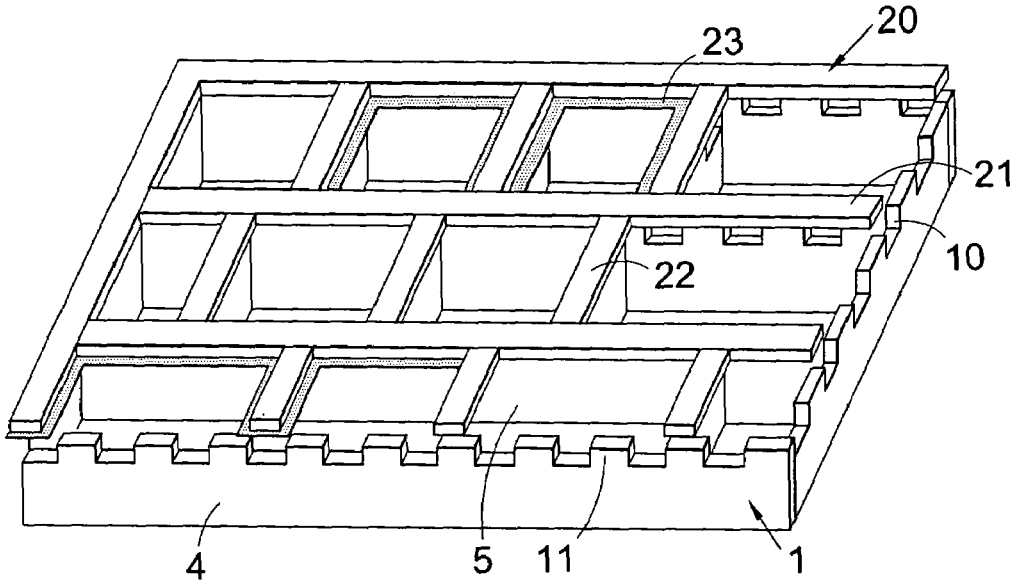
FIG. 2 is a perspective view from above of a base matrix frame and grout-holding frame such as shown in FIG. 1 but showing the grout-holding or "Channel-forming" frame operatively positioned on the base matrix frame.

Although each of FIGS. 1 to 3 shows crenellations only along the upper edge of some but not all of the partition walls 2,3 it is intended that these extend along all partition walls 2,3 substantially for their full length and also substantially along the full length of at least each of those boundary walls 4 that are intended to abut adjacent base matrix frames 1.

Furthermore, although not illustrated as such, the partition walls 2,3 are suitably of a thickness that is approximately double that of the boundary walls 4. The purpose of this is to ensure that the thickness of the walls is uniform throughout the ultimately assembled arrangement of base matrix frames 1 both between base matrix frames 1 and between the compartments 5 of each frame 1. This is important in order for the arrangement of base frames 1 to give uniform robust support over the full area to be paved so that later on during the concrete laying process the area may be walked over and, indeed, a wheelbarrow or other receptacle carrying concrete may be advanced over the area (suitably having first laid boards over the tops of the base matrix frames 1).

With reference to FIG. 3, during the initial stage of installation of the system a plurality of base matrix frames 1 are placed side-by-side in an arrangement to enable the paving to cover the full extent of the area to be paved. The abutting border walls 4 of the adjacent base matrix frames 1 can be readily held together by simple securing clips 12 that are suitably resilient and press-fit over the upper edges of the abutting border walls 4. As shown, these securing clips 12 suitably locate over the walls 4 within the apertures/recesses 10. Only a relatively small number of them need be used to hold the assembly of the base matrix frames 1 in the desired configuration on the ground.

With the assembly of base matrix frames 1 in place, the next major component f the system, a grout channel-forming, or grout-holding, frame 20, is lowered into place on top of each base matrix frame 1.

As can be seen in FIG. 1, the grout-holding frame 20 is a grid/matrix frame of longitudinal and transverse members 21, 22 configured directly to correspond to the longitudinal and transverse border walls 4 and partitioning walls 2,3 of the base matrix frame 1 so as to overlie/cap their upper edges.

The grout-holding frame 20 is suitably substantially rigid at least in so far as the mutual spacing of the longitudinal and transverse members is defined, but may have the nature of a sheet that can be stored in a rolled up state and then rolled out over the base matrix frame 1.

The skeleton of the grout-holding frame 20 may, like the base matrix frame 1, also be formed of PVA coated card/compressed paper. It carries beneath it strips of grout 23 extending the length of the longitudinal and transverse members 21,22 and glued to the underside of the grout-holding frame 20 by a peelable adhesive that will enable the frame 20 to subsequently be peeled away from the grout strips 23, leaving them in place along the top edges of the bas matrix frame 1 walls 2,3,4.

Referring to FIG. 2, the illustrated grout-holding frame 20 is shown as not having any member 21, 22 extending along its near side or right hand end as viewed and the transverse members 22 that terminate at the nearside edge and longitudinal members 21 that terminate at the right hand edge when positioned on the base matrix frame 1 are foreshortened so that they only partially overlap or reach but do not overlap the corresponding border walls 4 of the base matrix frame 1. This is to allow for dose adjacent placement of the next adjoining base matrix frame 1 and associated next adjacent grout-holding frame 20. For the same reason, at the outer borders 4 of the illustrated base matrix frame 1 (rear edge and left-hand edge as viewed), the grout-holding frame 20 and associated grout strip 23 overhang.

Accordingly, when a first base matrix frame 1 is butted to a second base matrix frame 1, the grout-holding frame 20 of one overlaps the top edges of the front and right border walls 4 of the other. The grout strips 23 although only shown on part of the grout-holding frame 20 in FIG. 2 do extend throughout the grout-holding frame 20. Furthermore, the grout strips 23 are shown as spreading beyond the sides of each grout-holding frame member 21,22 to which they are mounted thereby defining an overhang portion 24 of the grout strip 23 on each side of each member 21,22 of the grout-holding frame 20. This overhang portion 24 is important to serve as an anchor that beds the grout strip 23 into the concrete during the next stage of the procedure in which the wet concrete is poured into the base matrix frame 1 compartments 5 (see FIG. 5). The grout strip 23 can be of an upstanding/vertical nature straddling the base matrix frame 1 walls 2,3,4.

Figure 5:
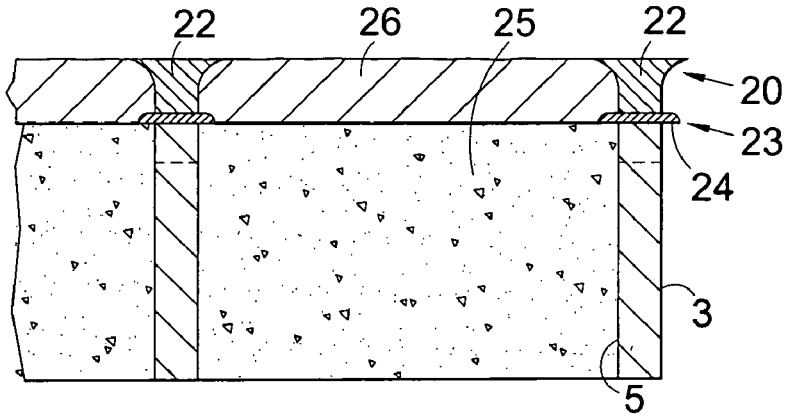
FIG. 5 is a schematic transverse sectional view of paving formed using the system of the invention.

Although the overhang 24 of the grout strips 23 is illustrated in FIG. 5 as extending substantially perpendicularly from the strips 23, i.e. perpendicularly to the partitioning 2,3 and border 4 walls of the base matrix frame 1, an alternative preferred arrangement is to have them extending inclined at least somewhat downwardly into the respective compartments 5. A downward angling of the overhangs 24 of the grout strips 23 will minimise disruption to concrete flow being poured into the compartments 5 and may ensure more uniform spread of the concrete.

Figure 4:
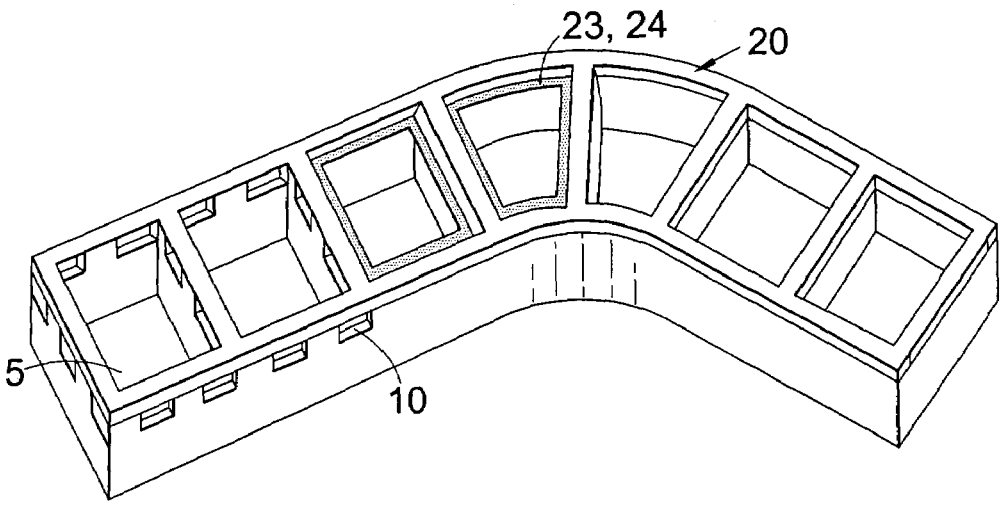
FIG. 4 is a view similar to FIG. 2 of a curved base matrix frame and grout-holding frame suitable for providing edging to the paving.

FIG. 4 illustrates a bas matrix frame 1 and associated grout-holding frame 20 that are particularly suited for use as edging to a paved area. As can be seen, the base matrix frame 1 and grout-holding frame 20 are not only with distinctive curved form of a single row of compartments 5 but it would also be noted that the grout-holding frame 20 fits neatly flush with the bas matrix frame 1 throughout, i.e. the grout-holding frame 20 does not extend beyond the base matrix frame on one side and fall short of it on the other, unlike the previously described embodiment. The edging do s not need to be seen to be integral with the main area of paving and, accordingly, there is no need for overlap of the grout strips 23 between one base matrix frame and associated grout-holding frame and the next.

Although not shown in FIG. 4, the outer boundary wall 4 of the edging base matrix frame 1 is suitably provided with a blanking strip extending the length of the outer boundary wall 4 to close off the apertures/crenel recess 10 to prevent leakage of concrete beyond the edging border.

In a first preferred procedure for laying concrete paving using the apparatus of the invention, the preparative stages are, as conventional, to firstly build up a bed of hardcore on the ground to be paved and to level the hardcore before then spreading across the top of the hardcore a sand screed. Once this is done the base matrix frames 1 are then placed on top of the screeded surface in the desired arrangement to cover the area to be paved. Adjacent base matrix frames 1 are clipped together with the clips and a corresponding grout-holding frame 20 is fitted on top of each base matrix frame 1. As discussed previously, the grout-holding frames 20 will generally overlap the base matrix frames 1 along two edges, integrating the whole assembly.

The cement mix freshly prepared is suitably deposited in each of the compartments 5, suitably by advancing a wheelbarrow of fresh concrete out over the area to be paved riding on boards laid across the top of the frame assembly 1, 20, and filling the compartments up to a level that is dose to being flush with the tops of the grout-holding frames 20. A coloured powder is suitably then applied to the exposed upper concrete layer then smoothed, suitably by trowel, to give the paving the desired colour finish.

Once the colour mix has been added to the concrete and before the concrete sets, a desired surface pattern is generally then imprinted in the concrete using a contoured roller or other suitable imprinting tool of which there are many currently available and used in conventional pattern-imprinted concrete laying.

Once the concrete has substantially set the grout-holding frame 20 is then detached from the grout strips 23 leaving them behind and embedded in the concrete in exactly the configuration dictated by the frames 1, 20, between each of the concrete blocks defined by the frame compartments.

Following removal of the grout-holding frames 20, the concrete will, on average, set within a couple of days enabling the paving to be walked upon or driven upon. An acrylic sealant is suitably applied to the top of the concrete when it has substantially set in order to protect the concrete surface and grout from weathering and enhance the finished appearance, and to enable oil and dirt to be removed easily.

As can further be seen from FIG. 5, the skeleton of the grout-holding frame 20, suitably formed of compacted card, has a clearly defined profile/transverse sectional shape which is responsible for giving the exposed upper edges of the concrete blocks a desired shape, in this case, a rounded shape. In particular it will be seen that the profile/section of each grout-holding frame member 21, 22 is of a fluted form, giving rise to the round-edged form of the top of the blocks 25. It will also be appreciated that the size and shape of the grout-holding frame 20 skeleton determines the size shape and depth of the channel between each block when the grout-holding frame 20 is removed, leaving the grout strips 23 behind. On average the preferred depth of channel to be formed is between 3 mm and 5 mm and the preferred thickness of grout 23 may be of the order of 3 mm. However this can vary depending on the pattern and style of pattern which can include varying shapes and sizes such as cobble, slate, stone, tile, brick etc.

The concrete is linked throughout as a substantially monolithic structure by virtue of the concrete bridges formed by the concrete flow between compartments through the apertures of the crenellation recesses 10 or other apertures that extend through the partitioning or boundary walls 2,3,4 of the base matrix frames 1.

As time passes, the degradable base matrix frames 1 will disintegrate leaving the interlinked blocks with substantial voids between them that function as shear and expansion lines. All blocks will be connected or touching on shearing maintaining stability, preventing spreading or sideways movement.

Significantly, the bridging concrete between the blocks not only gives the paving structural integrity, it also provides support to the overlying grout strips. Indeed, the bridging concrete would generally be sufficient to prevent even a woman's stiletto heel from penetrating between the blocks. However, as a further safeguard against this, the bridging concrete between blocks can be strategically configured by further refinements to the base matrix frame 1 construction as illustrated in FIG. 8.

Figure 8:
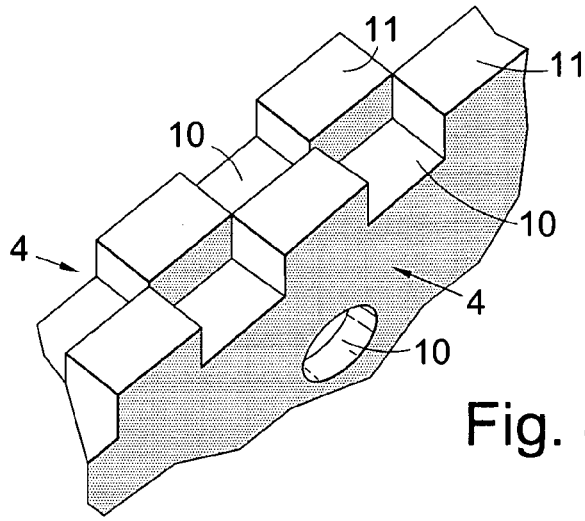
FIG. 8 is a schematic perspective detail view of a staggered arrangement of castellation of adjacent base matrix frames.

Referring to FIG. 8, this shows the boundary wall 4 of one base matrix frame 1 in position butting up against the corresponding adjacent boundary wall 4 of an adjoining base matrix frame 1 and where the crenellations 10 along the top edge of each border wall 4 are staggered relative to each other. In consequence, a raised portion 11 of the crenellation of one base matrix frame 1 lies directly next to and therefore obstructs the crenel/recess 10 of the next base matrix frame 1 preventing through-flow of concrete but providing the basis for staggered concrete projections to be formed in the recesses 10 to give support to the overlying grout strip for the full length of the border wall. Accordingly, once the border wall has disintegrated the concrete support immediately underlying the grout strip remains.

To compensate for loss of through-flow of bridging concrete through the crenel recesses 10, separate throughflow apertures 10' are provided through the border walls 4 lower down, as illustrated.

Whereas the FIG. 8 arrangement is described and illustrated with respect to the border walls 4, this arrangement applies equally to the partitioning walls 2,3 and can most readily be used with them when the partitioning walls 2,3 are formed as two-ply or double thickness walls whereby one half of their thickness is crenellated in a first sequence, and the other half of their thickness is crenellated in a second sequence that is staggered relative to the first sequence. By this means all upper edges of all walls, both border 4 and partitioning 2,3 of each base matrix frame 1 have the desired staggered configuration of crenellations to provide uniform support throughout to the corresponding overlying grout strips 23.

In the above described procedure, while laying the cement, w have suggested that the cement mix be poured into the compartments 5 of the base matrix frame 1 once the grout-holding frame 20 is in place and is then topped off with coloured powder. In a refinement to this process to minimise any risk of uncoloured areas two different alternative procedures may be adopted. In the first alternative the assembly of base matrix frames 1 is installed and plain concrete poured into the compartments 5 prior to mounting the grout-holding frames 20 and then filling these with coloured concrete mix. Indeed, it is this embodiment that is illustrated in FIG. 5 where one can clearly see the top layer 26 of colour mix concrete above the base matrix frame 1, within the grout-holding frame 20.

In a second alternative procedure, instead of using plain concrete with a coloured powder or colour mix, a fully coloured concrete mix may be used alone and be poured into the fully assembled base matrix frame 1 and grout holding frame 20 assembly to be level with the top of the grout-holding frame 20. This option is the simplest to implement but is subject to the somewhat higher costs of having enough pigment to colour the concrete throughout rather than simply the topmost layer.

In the above described embodiments the grout-holding or channel forming frame 20 is described as holding grout to be left in situ overlying the walls 2,3,4 of the corresponding base matrix frame 1. Alternatively, however, the grout channel forming frame 20 need not hold a grout material itself but may be a frame that still has the corresponding plan shape to the plan shape of the base matrix frame 1 but serves solely to form the grout channels between the compartments 5, i.e. between the paving blocks as they are formed, and which is removed once the concrete has substantially set. Separate grouting material, e.g. a wet or powder grout, may then be placed into the grout channels between the blocks left behind following removal of the grout channel forming frame 20.

Figure 6:
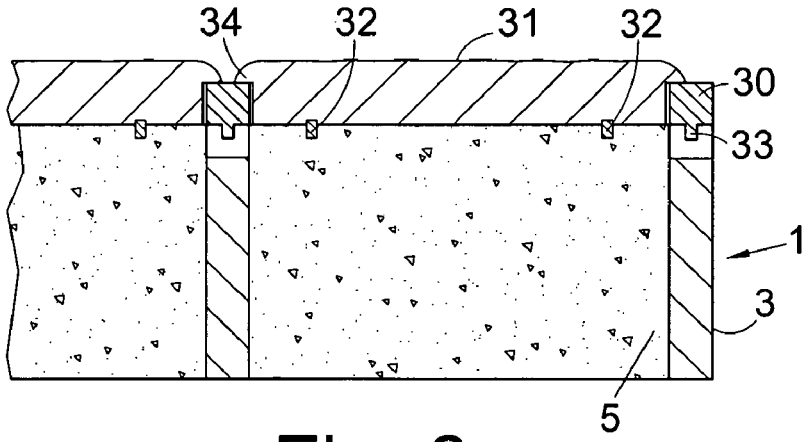
FIG. 6 is a transverse sectional view of a pavement formed using an alternative embodiment of the invention.
Figure 7:
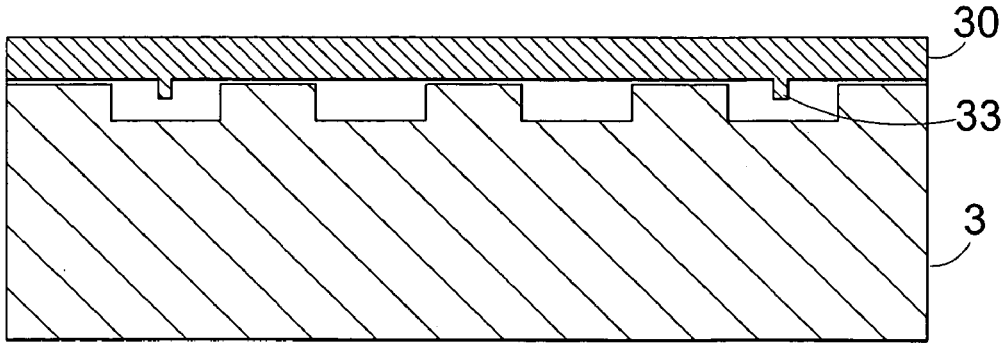
FIG. 7 is a side elevation view of the FIG. 6 pavement.

Turning now to FIG. 6, this illustrates an alternative embodiment of the invention in which the base matrix frame 1 is substantially as in the previously described embodiment but which differs significantly in that the topmost surface of the paving comprises preformed paving tiles, suitably preformed of concrete and/or resin, and the grout-holding frame 20 being replaced by a grout frame 30 that functions as the grout itself and which is left in situ during the laying process. Grout frame 30 is similar in plan to the grout-holding frame 20 of the first embodiment and is suitably simply formed of grout medium and has, as illustrated, a cross-section that is suitably rectangular, being of a width equivalent to the width of the partition walls 2,3 or border walls 4 of the base matrix frame 1 to directly overlie those walls 2,3,4. As with the grout-holding frame 20, the frame 30 is, however, suitably configured to provide overlap from on base matrix frame 1 to the next. Here, the concrete tiles 31 are formed of a profile having an overhang lip 34 on all sides to seat on top of the correspondingly positioned member of the grout frame 30.

The concrete tiles 31 are suitably each formed with studs 32 on their undersurface to bed into the freshly poured concrete that is first poured into the compartments of the base matrix frame 1. The level of the poured concrete suitably comes to the level of the bottom edge of the grout frame 30, as illustrated, and anchoring of the grout frame 30 is suitably achieved by similar studs 33 provided on the underside of the grout frame 30 that project into the concrete where the concrete has flowed int the crenel recesses 10 of the base matrix frame 1.

The pre-manufactured paving tiles 31 are suitably delivered in pack form. The studs on the undersides of the tiles 31 may be moulded of the concrete from which the tiles are moulded or may be plastics or other suitable material that is compatible with concrete and thereby provides a good long term secure anchoring of the tiles 31 into the poured concrete in the base matrix frame 1.

The procedure for laying this embodiment of paving is suitably to begin by setting out the base matrix frames 1 in the desired configuration of assembly. The concrete is then poured and smoothed off and the grout frames then placed onto the base matrix frames 1 (overlapping as per the earlier embodiment grout frame 20). Then the overlapping tiles 31 are placed onto the grout frames 30 and secured into the wet/soft concrete in the compartments 5.

Figure 9A:
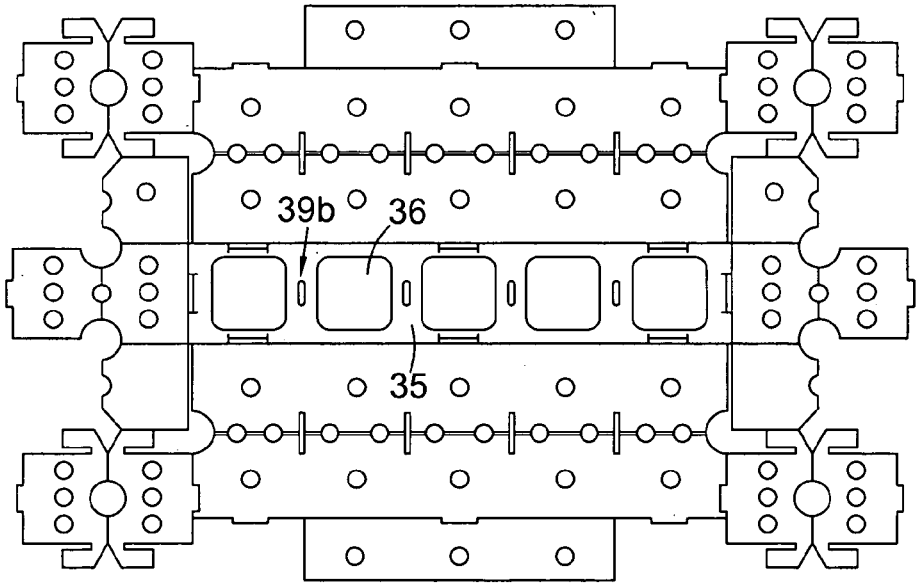
FIG. 9A is a plan view from above of a blank of corrugated cardboard or other suitable material that may be folded to assemble into a base frame that is one row of compartments wide and, when transverse/divider walls are inserted in place, comprises five compartments in a series with the walls of the base frame being two ply thick.
Figure 9B:
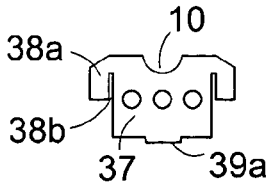
FIG. 9B is an elevation view of a transverse/divider wall.
Figure 9C:
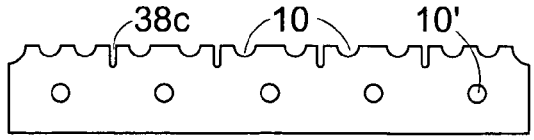
FIG. 9C is an elevation view of a longitudinal side wall of a base frame assembled from the blank of FIG. 9A.

Turning now to FIGS. 9A to 9C, these show details of the preferred construction of the base matrix frame 1 using a corrugated cardboard blank, outer panels of which are folded up and over to form two ply upstanding sidewalls and end walls to the frame. The base frame 1 here has a floor 35 that is, for each compartment, perforated by a respective large generally square central aperture 36. The compartments in the assembled base frame 1 are defined by transverse dividing walls 37 such as shown in FIG. 9B. The dividing wall 37 has tabs 38*a* on its opposing side edges that overhang and define slits 38*b* which co-operatively engage with the opposing parallel sidewalls such as shown in FIG. 9C suitably slottingly engaging with complementary slits 38C on those sidewalls.

Location each of the dividing walls 37 within the bas frame suitably also entails location of a bottom protrusion 39*a* of each dividing wall into a respective slit 39*b* in the floor 35.

In the FIG. 9 illustrations the base frame is seen to have arcuate crenellations 10. These are easier to punch from card using conventional punching equipment with less risk of jamming of the punch mechanism than is the case with polygonal/straight sided crenellations.

Figure 10:
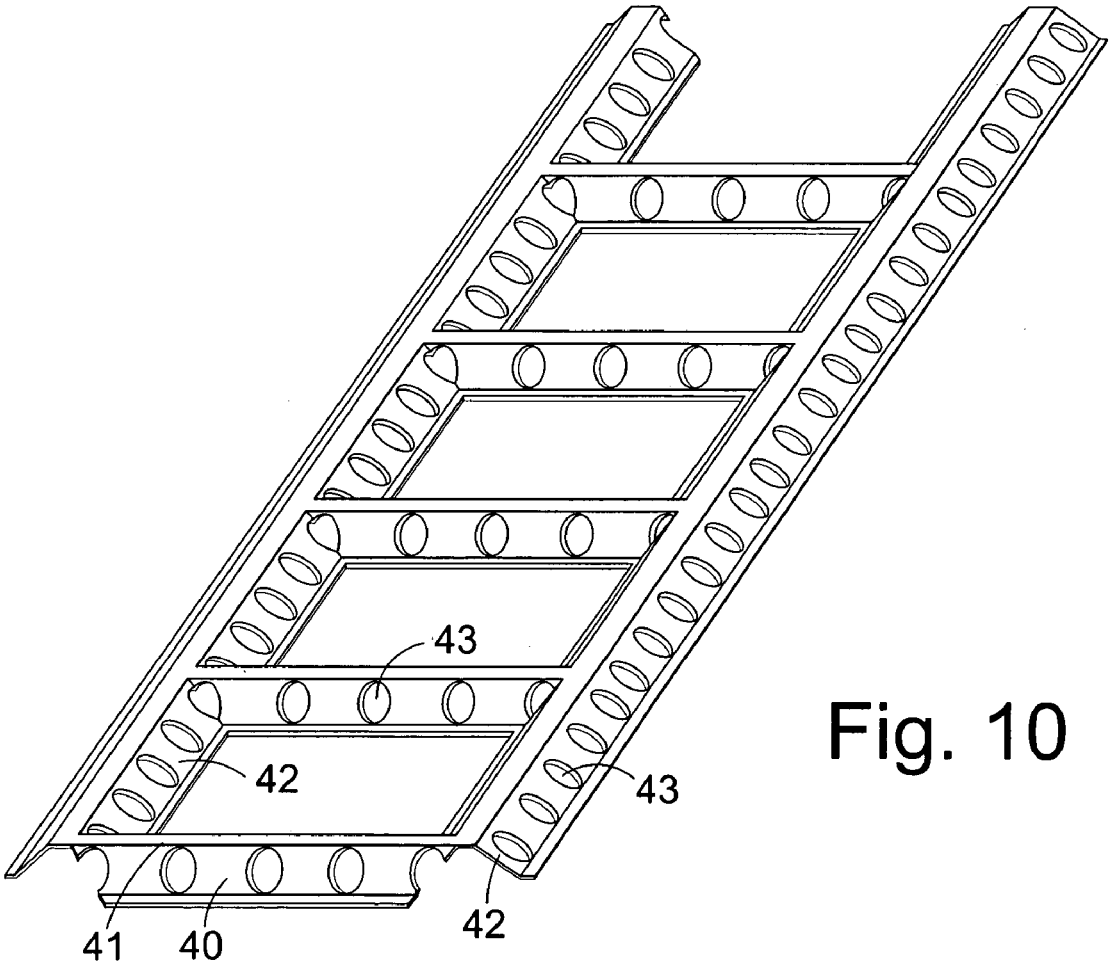
FIG. 10 is a perspective view from above of a particularly preferred variant of the grout frame of the FIG. 1 embodiment.

Referring finally to FIG. 10, this shows a variant of the grout frame that has the structural integrity of the frame provided not by the over-lying grout holding frame/cover component 41 but by the rigid frame-shaped grouting component 40 which is suitably moulded of a plastics material such as nylon, polypropylene or reconstituted plastics and which has each member of its grid/lattice-work with an arched profile.

The cover component 41 is here shown as a much thinner component than the corresponding cover component 41 grout holding frame 20 shown in FIG. 1 but may be thicker if required to provide a greater depth of inset of the grouting below the paving top surface. It is still frame-shaped in plan but is of a relatively soft, flexible and preferably elastomeric resilient material that is readily peelable away from the top of the frame-shaped grouting component 40 when the grouting component 40 is securely anchored in the set/setting concrete. The resilient nature of the cover component 41 may also facilitate trowelling and smoothing of the cement including any to player colouring cement or screed.

The arched profile of the members of the lattice-work of the grouting component 40 provides the downwardly inclined lateral extensions/flanges 42 of the grouting component 40 that bed into the concrete and anchor the grouting component 40 in place.

Apertures 43 in the lateral extensions 42 of the grouting component 40 may, if required, be large enough to allow the cement to ooze though to better even out the distribution of the cement, but most importantly help to prevent air pockets from forming under the extensions 42.

What is claimed is:

1. An apparatus for forming paving from a settable material and which comprises:

i) a base frame having a plurality of upstanding walls which, alone or together with an adjacent positioned said base frame, defines a plurality of compartments within which the settable material may be placed to be molded by the compartments of the base frame(s) into a plurality of blocks, the base frame being adapted to be left in situ; and ii) a grout frame which is of a substantially corresponding shape in plan to the base frame and which is positioned atop the walls of the base frame in use, extending the walls upwardly, wherein the grout frame is an assembly that comprises a carrier/cover component on the underside of which is a grouting component that serves as a grouting, at least one of the carried/cover component and the grouting component being sufficiently rigid as a frame to maintain said shape in plan, the carrier/cover component being separable from the grouting component for removal of the carrier/cover component once the settable material has set to expose the grouting component which is left in situ.

2. An apparatus as claimed in claim 1, wherein the carrier/cover component is sufficiently flexible to be separable from the grouting component by peeling away from the grouting component when the grouting component is anchored down by the setting of the settable material.

3. An apparatus as claimed in claim 1, wherein the grouting component extends beyond the top edge of the carrier/cover component into the compartments to be embedded in the settable material.

4. An apparatus as claimed in claim 3, wherein the grouting component extends inclined downwardly beyond the top edge of the carrier/cover component.

5. An apparatus as claimed in claim 3, wherein the part of the grouting component that extends beyond the top edge of the carrier frame into the compartments to be embedded in the settable material has at least one aperture therethrough.

6. An apparatus as claimed in claim 1, wherein walls of the base frame(s) between adjacent compartments have one or more apertures therethrough to enable a settable material to flow from one compartment to the next to interlink the paving blocks formed as the settable material sets.

7. An apparatus as claimed in claim 1, wherein the base frame is of matrix form defining said plurality of compartments within which the settable material may be placed.

8. An apparatus as claimed in claim 6, wherein there are a number of said one or more apertures and these are formed as crenellation recesses in the upper, in use, edges of the walls between the compartments of the base frame(s).

9. An apparatus as claimed in claim 8, wherein further apertures are formed in the walls between compartments lower down the walls than the crenellation recesses.

10. An apparatus as claimed in claim 8, wherein the crenellation recesses in the walls between compartments are at least partly staggered as they run through the walls and if fully staggered and thereby occluded are provided only in combination with said further apertures.

11. An apparatus as claimed in claim 1, wherein one or more recesses are formed in the walls between compartments lower down the walls than the upper edges of the walls.

12. An apparatus as claimed in claim 1, wherein the base frame is of cardboard or other degradable material.

13. An apparatus as claimed in claim 7, wherein there are a number of said one or more apertures and these are formed as crenellation recesses in the upper, in use, edges of the walls between the compartments of the base frame(s).

14. An apparatus for forming paving from a settable material and which comprises:

a base frame having a plurality of upstanding walls and a grout frame positioned on said base frame, said base frame defining a plurality of compartments within which the settable material may be placed to be molded by the compartments of the base frame(s) into a plurality of blocks, the base frame being adapted to be left in situ; and a plurality of preformed paving tiles, one to cap each of said plurality of blocks, wherein each of said preformed paving tiles is mounted on a portion of the grout frame and positioned atop a corresponding compartment of the base frame and being in contact with the settable material prior to the setting thereof to be thereby secured in place.

15. An apparatus as claimed in claim 14, wherein the grout frame has protrusions on its underside that bed into settable material within recesses in the upper edge of the base frame.

* * * * *